US006574926B2

(12) United States Patent
Richardson

(10) Patent No.: US 6,574,926 B2
(45) Date of Patent: Jun. 10, 2003

(54) ROOF CONSTRUCTION

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/506,124

(22) Filed: Feb. 17, 2000

(65) Prior Publication Data

US 2001/0047630 A1 Dec. 6, 2001

(30) Foreign Application Priority Data

Mar. 18, 1999 (GB) ..... 9906078

(51) Int. Cl.[7] ..... E04B 7/04

(52) U.S. Cl. ..... 52/204.5; 52/204.705; 52/92.2; 52/DIG. 17

(58) Field of Search ..... 52/204.5, 204.705, 52/204.7, 92.2, 92.1, 93.1, 93.2, 101, DIG. 17

(56) References Cited

U.S. PATENT DOCUMENTS

| | | | | | |
|---|---|---|---|---|---|
| 1,168,942 | A | * | 1/1916 | Irwin | 52/395 |
| 2,531,229 | A | * | 11/1950 | Marsh | 52/543 |
| 2,552,865 | A | * | 5/1951 | Radnall | 52/464 |
| 3,928,951 | A | * | 12/1975 | Murphy | 52/92.2 |
| 4,057,941 | A | * | 11/1977 | Schwartz | 52/DIG. 17 X |
| 4,327,532 | A | * | 5/1982 | Matthews | 52/92.2 |
| 4,601,139 | A | * | 7/1986 | Esposito | 52/DIG. 17 X |
| 4,930,268 | A | * | 6/1990 | Fritz et al. | 52/93.2 |
| 5,274,974 | A | * | 1/1994 | Haag | 52/300 |
| 5,568,707 | A | * | 10/1996 | Ishikawa et al. | 52/200 |
| 5,836,117 | A | * | 11/1998 | Johnson | 52/201 |
| 6,151,845 | A | * | 11/2000 | Lancaster | 52/198 |
| 6,192,643 | B1 | * | 2/2001 | Zadok | 52/DIG. 17 X |
| 6,438,913 | B1 | * | 8/2002 | Ishikawa et al. | 52/235 |

FOREIGN PATENT DOCUMENTS

| | | |
|---|---|---|
| EP | 091361 | 10/1983 |
| FR | 2608192 | 6/1988 |
| FR | 2762071 | 10/1998 |
| GB | 1585930 | 3/1981 |
| GB | 2256880 | 12/1992 |
| GB | 2259926 | 3/1993 |
| GB | 2321925 | 12/1998 |

* cited by examiner

*Primary Examiner*—Carl D. Friedman
*Assistant Examiner*—Brian E. Glessner
(74) *Attorney, Agent, or Firm*—Wood, Phillips, Katz, Clark & Mortimer

(57) ABSTRACT

A glazed roof comprises glazing bars supporting glazing panels secured to a supporting structure by means of screws through fixing blocks mounted at the glazing bar ends, the fixing blocks having provision for receiving and directing the fixing screws.

4 Claims, 5 Drawing Sheets

ROOF CONSTRUCTION

BACKGROUND OF THE INVENTION

This invention concerns roof construction and, in particular, concerns glazed roof construction, such as for forming a conservatory.

Conservatory roofs are generally formed from glazing panels supported between glazing bars fixed between a ridge beam and an eaves beam or other side supporting structure, such as a window frame. The glazing bars are usually of aluminum and screws are used to fix the glazing bars to the supporting structure. A difficulty with the use of screws directly through glazing bars is that they can slip as they are being screwed in. That creates particularly difficulties when screwing down ducted glazing bars when the screws are fixed into and through the ducts. Putting the screws through the ducts is better for concealment and neatness but is more difficult practically.

Another problem with the use of screws directly through glazing bars into a supporting structure is that of cold transference where the glazing bars supporting structure component and the screws are all of metal. When the outside of the conservatory roof is colder than the inside, cold spots and hence condensation can form on the inside of the roof.

The above problems arise whether the glazing bar is of a type that supports glazing panels on opposite sides thereof or of the type that acts as reinforcement between glazing panels coupled to each other and/or to the glazing bars.

SUMMARY OF THE INVENTION

This invention provides a glazed roof comprising a supporting structure, glazing panels, glazing bars supporting the glazing panels, each glazing bar having two ends, and fixing blocks, each of which is mounted at one of the ends of an associated one of the glazing bars and each of which is secured directly to the supporting structure so as to secure the associated one of the glazing bars indirectly to the supporting structure. Each fixing block has two wings, each wing having means for positioning, aligning, and preventing slippage of one of the glazing panels.

Preferably, an end cap is attached to each fixing block. Preferably, the end cap attached thereto is attached slidably thereto. Preferably the fixing blocks are made of plastics material.

BRIEF DESCRIPTION OF THE DRAWINGS

This invention will now be further described, by way of example only, with reference to the accompanying drawings, in which.

DETAILED DESCRIPTION OF THE INVENTION

Figure 1:
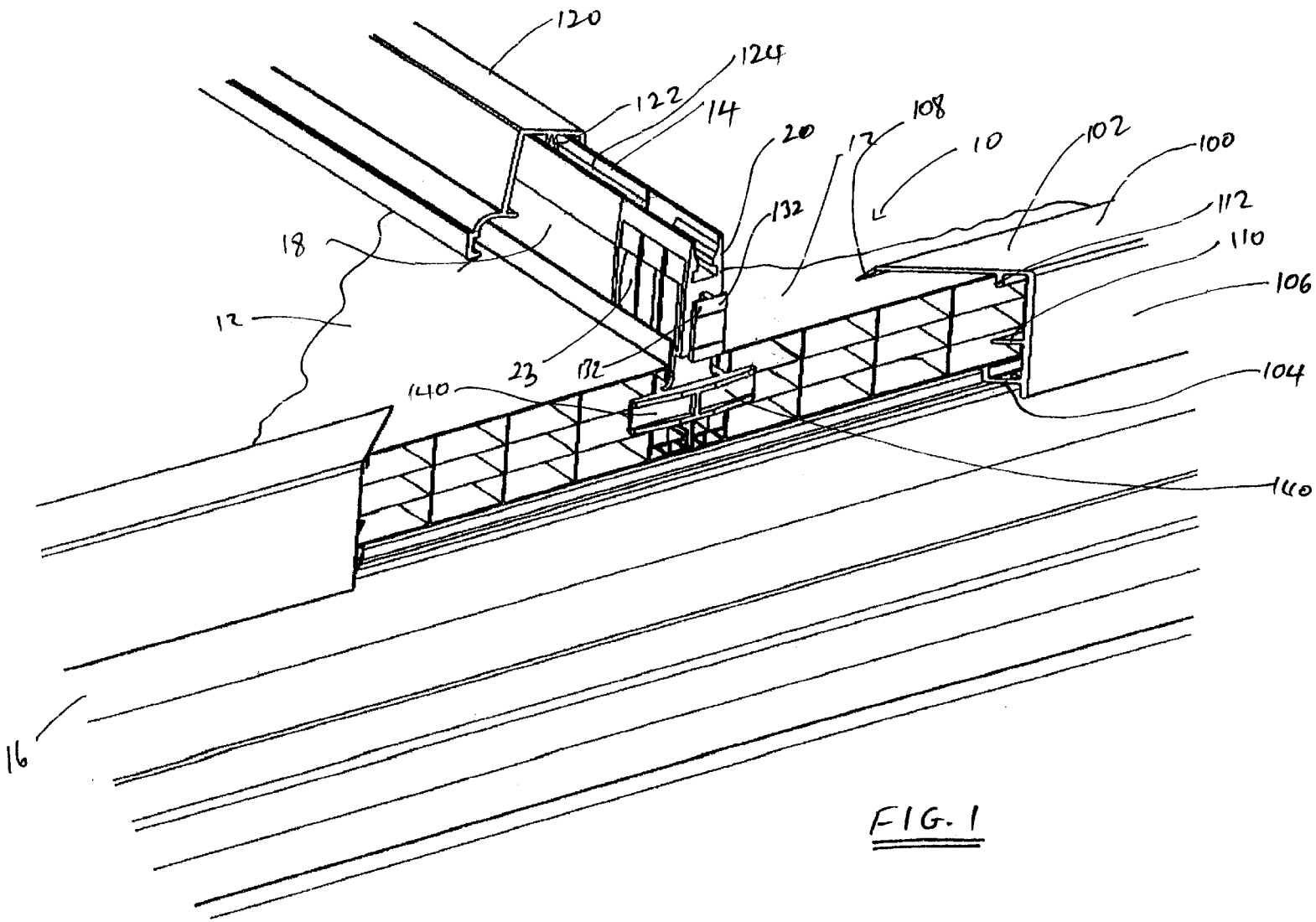
FIG. 1 is a partly cut away perspective view of a conservatory roof.
Figure 2:
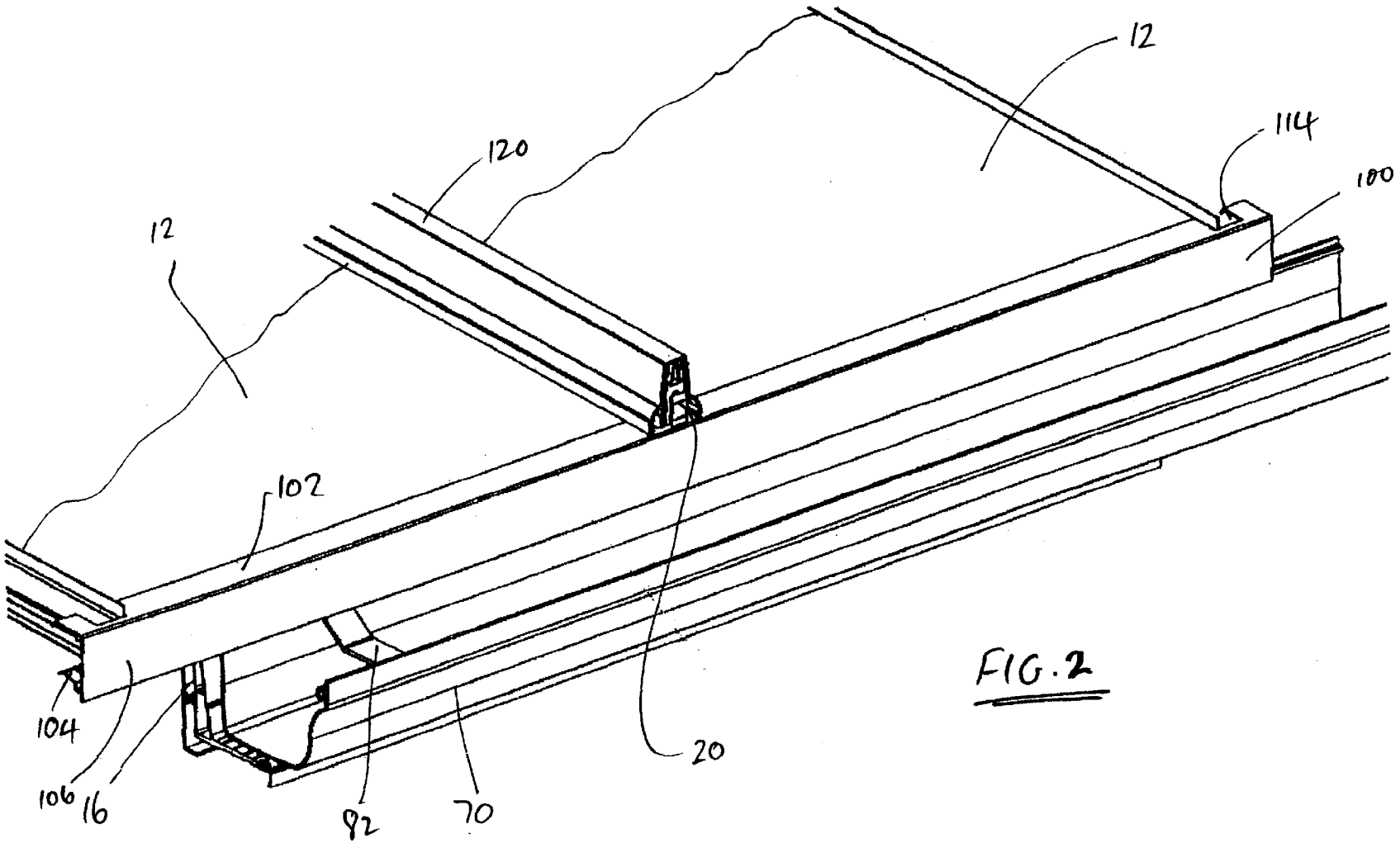
FIG. 2 is another perspective view of the roof of FIG. 1 not cut away.
Figure 3:
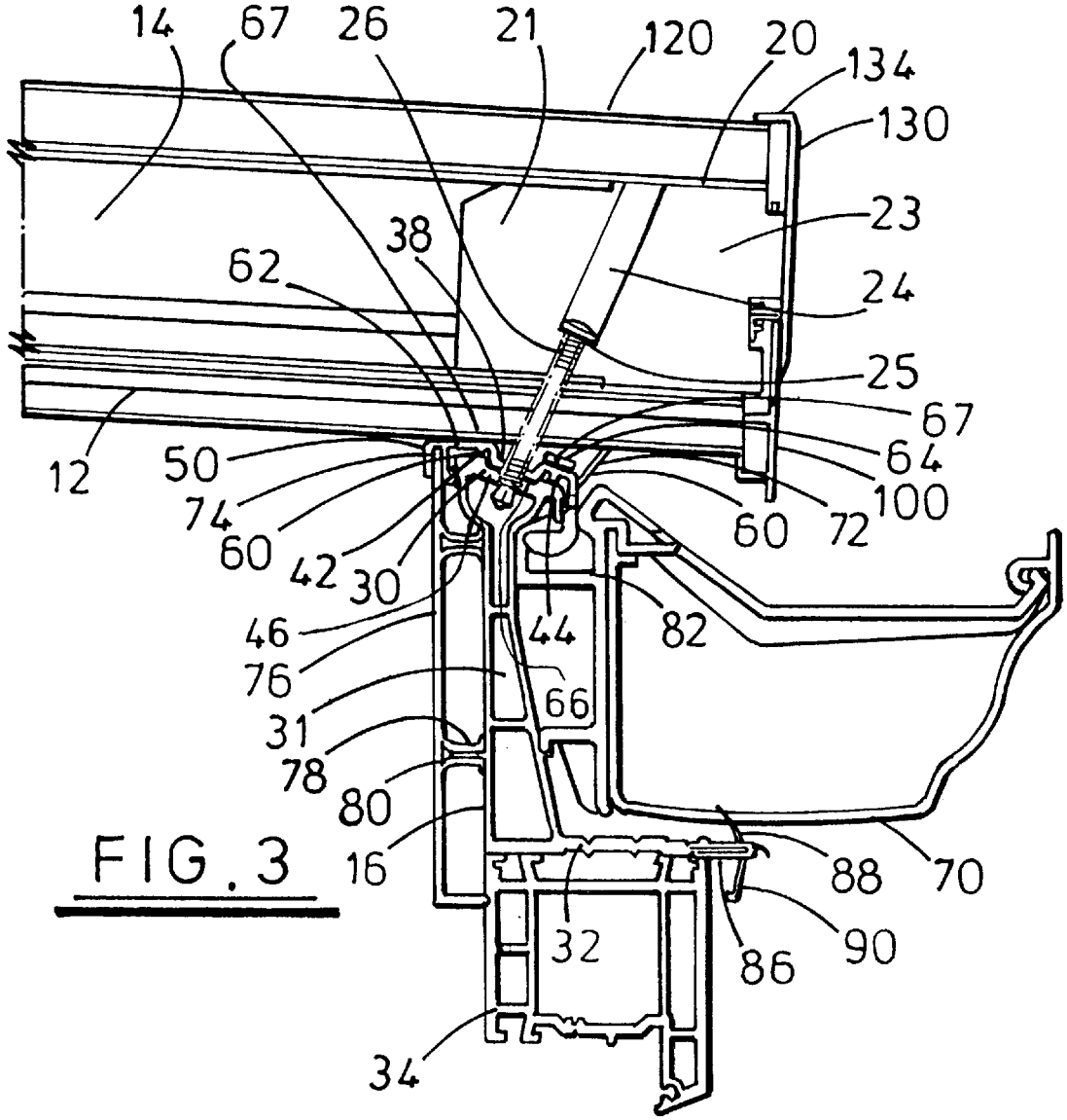
FIG. 3 is a section through the roof of FIGS. 1 and 2.

Referring to FIGS. 1 to 3 of the accompanying drawings, a conservatory roof 10 comprises glazing panels 12 supported between glazing bars 14 secured at one end to a ridge (not shown) and at the other to an eaves beam 16. The glazing bars 14 are of a type having a ducted upstand 18 into which are push fit fixing blocks 20 of plastics material, typically of PVCu. The fixing blocks have a first part 21 that fits into the glazing bar and second part 23 that remains outside the glazing bar but has a similar outer profile.

The fixing blocks 20 have an angled screw receiving and guiding hole 24 which is stepped at 25 to have a narrower lower part, the step 25 forming a stop for the head of a fixing screw 26. The screw 26 is shown securing the fixing block and hence the glazing bar to the head 30 of the eaves beam 16.

The eaves beam 16 is generally L-shaped having a double walled upstand 31 and a single walled base plate 32. The base plate 32 sits on and is secured to the underlying support structure, such as provided by window frames 34. The head 30 of the eaves beam has a generally arcuate top surface but with a depression 38 therein. The base of the depression has a serrated or roughened surface. Either side of the depression, the head of the eaves beam has two alternative inner and outer areas 42 and 44 respectively on which glazing bars can rest depending on the pitch of the roof. In this embodiment the roof illustrated has a low pitch and so the eaves beam 16 rests on the inner area 42.

Interposed between the glazing bars and the eaves beam and lying on the eaves beam is a thermal insulator strip 50 of plastics material. The insulator strip 50 snap fits onto the head 46 of the eaves beam.

The insulator strip is formed as an extrusion and has a profile generally following the contours of the head of the eaves beam. The insulator strip is provided with ribs 60 on its underside to space inner and outer parts 62, 64 thereof from the inner and outer areas 42, 44 of the eaves beam head, whilst a central part 66 of the insulator strip sits in the depression in the head of the eaves beam. The inner and outer parts 62, 64 of the insulator strip are provided on their top surfaces with double-sided adhesive tape 67 in order to hold the glazing bars 14 in place whilst they are being secured with the screws 26 to the eaves beam.

Extending forwardly of the insulator strip i.e. towards gutter 70 on the outside of the conservatory is a thin resiliently flexible web 72. The web 72 contacts the underside of the glazing bar 14 or any bottom capping thereon or the underside of the glazing panels 12 to provide a wind break.

On its inner end i.e. the end towards the inside of the conservatory, the insulator strip has a lip 74 extending outwardly and then downwardly to form a slot which serves as a top location for internal plastics cladding 76 for the eaves beam 16. The eaves beam has lower down a fir-tree connector 78 along its length onto which a slot 80 of the cladding is a push-fit.

The eaves beam 16 supports brackets 82 for the gutter 70 and the leading edge of the base plate 32 of the eaves beam has a push-fit trim 86 thereon, which has a flexible resilient web 88 upstanding to seal between the underside of the gutter and the eaves beam. Furthermore, the trim has a downstand 90 to cover profile features.

The insulator strip provides a thermal break between the glazing bars and the eaves beam, which otherwise, both being of aluminum, would provide a route for heat loss leading to condensation formation within the conservatory on the eaves beam.

Ends of the glazing panels are concealed by a channel section trim 100 having a top wall 102, a bottom wall 104 and a base wall 106. The top wall 102 has along its edge a co-extruded or bonded gasket 108 of rubber or synthetic elastomeric material to seal against the top surface of the glazing panels. The bottom wall 104 is resiliently deformable to grip on the underside of the glazing panels. The base wall 106 has a spacing rib 110 extending therefrom as has the top wall 112 to leave a ventilation space between the glazing panel ends and the trim base wall. The trim 100 will usually be supplied pre-notched 114 to accommodate the glazing bars (see FIG. 2).

The glazing panels are held down by cappings 120 that are snap-fits into the tops of the glazing bars and of the fixing blocks whose top profiles match those of the glazing bars. The cappings 120 have depending resiliently deformable formations 122 that are retainable in a channel 124 in the top of the glazing bar having notched side walls the formations having lips that are retained under the notches according to how far the capping is pressed down.

To conceal the ends of the fixing blocks an end cap 130 is mounted on the fixing block. The fixing block has back to back L-shaped brackets 132 onto which facing L-shaped flanges (not shown) of the end cap can slide downwards until a rim 134 of the cap sits on top of the capping 120.

The fixing block 20 further has a pair of laterally extending wings 140 at its forward end from a depending part of the block. These wings are positioned to act as stops for the glazing panels, to position and align them. The wings 140 further act to prevent slippage of the panels in the assembled roof.

The fixing block enables the screw fixing to be accurately positioned and guided whilst be screwed down making erection of the roof simpler than hitherto.

Figure 4:
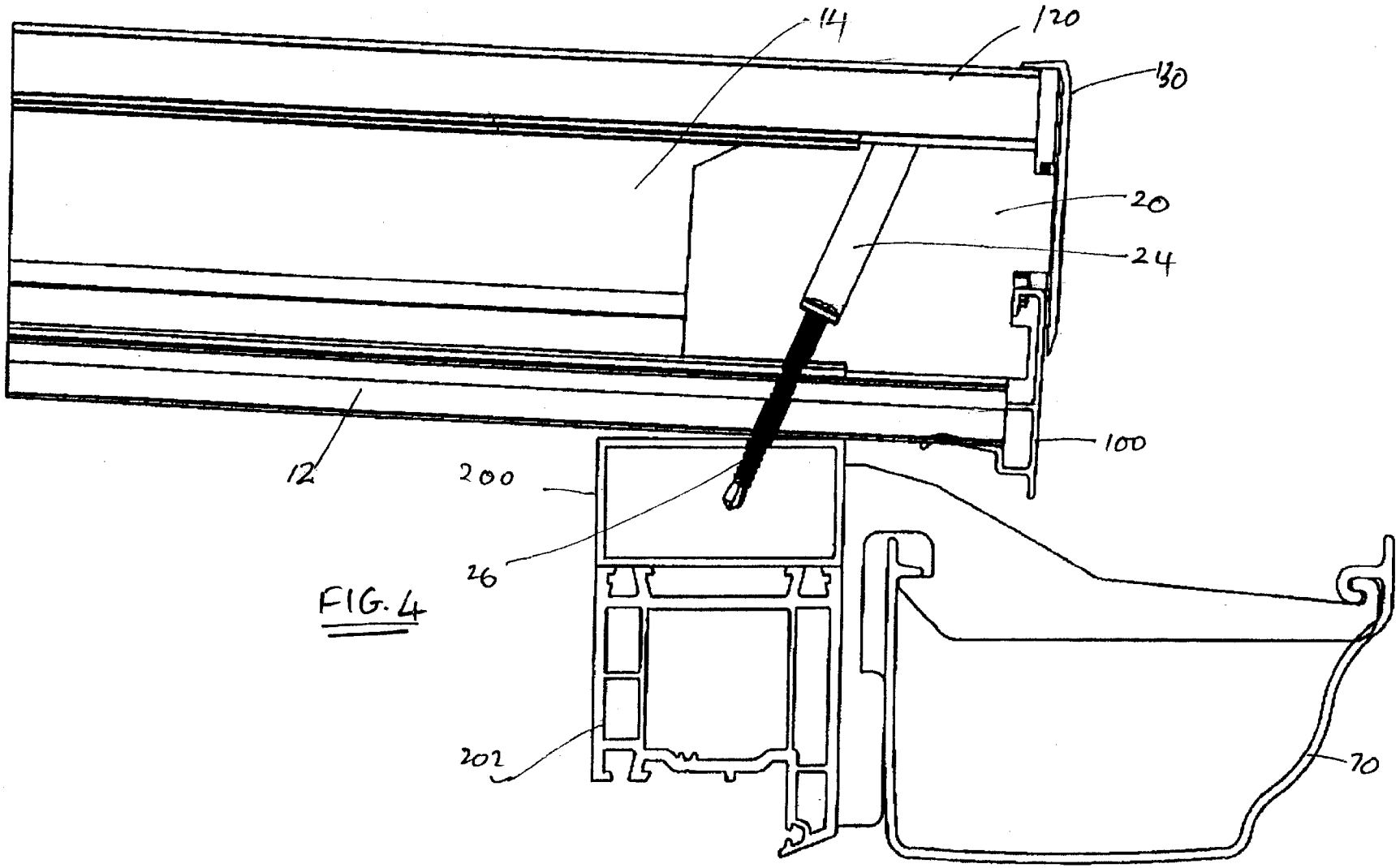
FIG. 4 is a section through a variation on the roof of FIGS. 1 to 3.

Turning to FIG. 4 of the drawings, instead of an eaves beam being used, a PVCu profile 200 is mounted on the window frame 202 and it is to the profile 200 that the fixing blocks 20 and hence the glazing bars 14 are secured by screws 26. Apart from that the embodiment of FIG. 4 is the same as that of FIGS. 1 to 3. Like parts have been given the same reference number for ease of reference and will not be described again.

Figure 6:
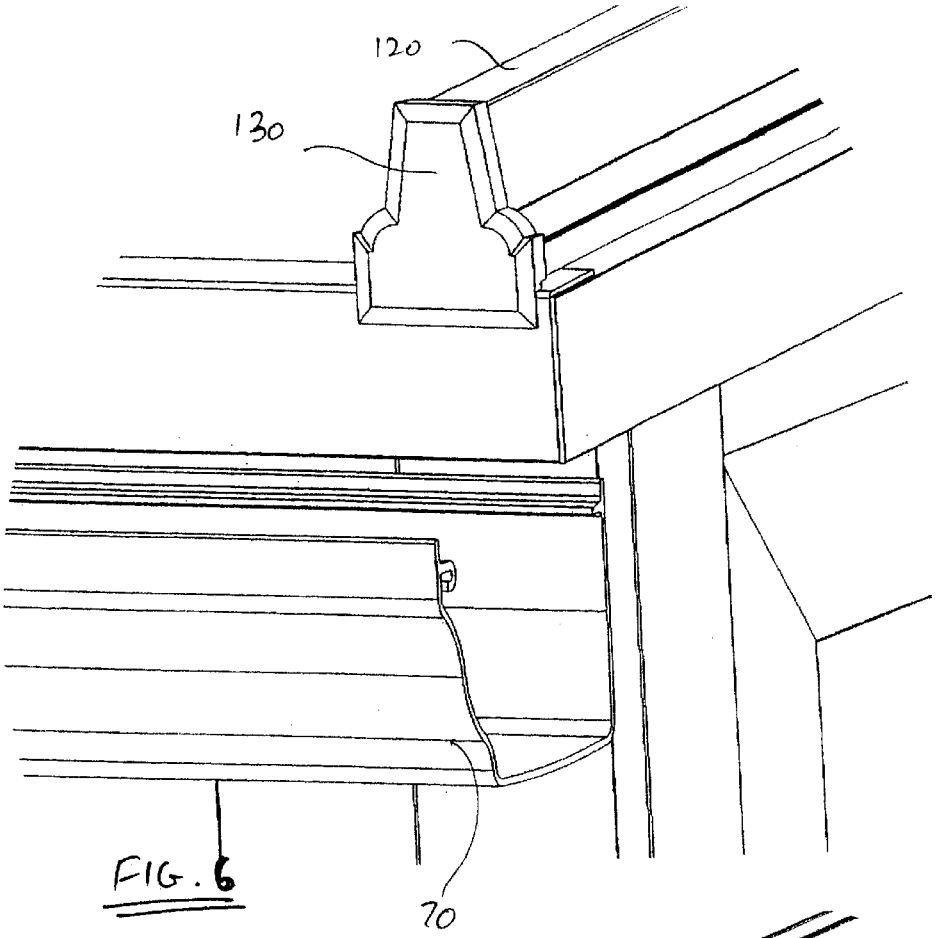
FIGS. 5 and 6 show a conservatory roof gable end partly and fully assembled.
Figure 5:
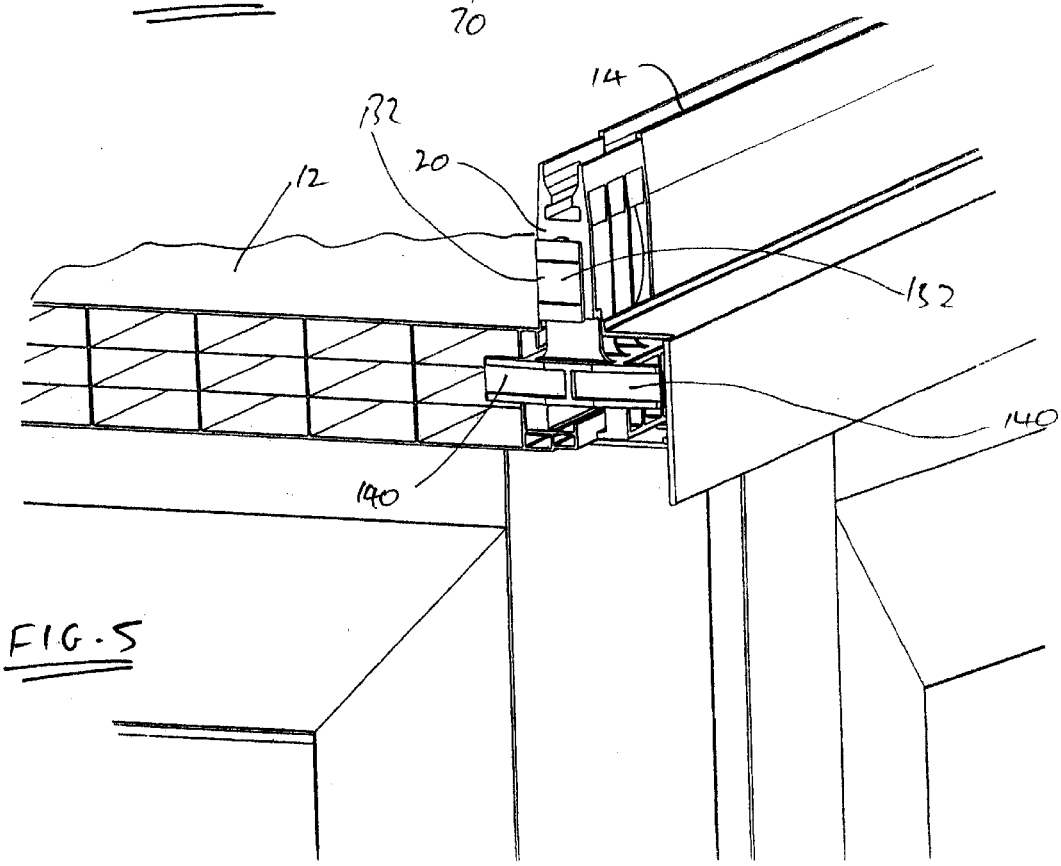

Finally, FIGS. 5 and 6 illustrate the use of fixing blocks at the gable end of a conservatory roof made up of ducted plastic panels 12 coupled to the glazing bars 14. The fixing block and its use are the same as described above together with the attachment of the end cap 130 as shown in FIG. 6.

What is claimed is:

1. A glazed roof comprising a supporting structure, glazing panels, glazing bars supporting the glazing panels, each glazing bar having two ends, and fixing blocks, each of which is mounted at one of the ends of an associated one of the glazing bars and each of which is secured directly to the supporting structure so as to secure the associated one of the glazing bars indirectly to the supporting structure, each glazing block having two wings, each wing having means for positioning, aligning, and preventing slippage of one of the glazing panels, both wings being in contact with edges of the glazing panels.

2. The glazed roof of claim 1 wherein an end cap is attached to each fixing block.

3. The glazed roof of claim 1 wherein an end cap is attached slidably to each fixing block.

4. The glazed roof of claim 1, 2, or 3 wherein the fixing blocks are made of plastics material.

* * * * *